US007984871B2

(12) United States Patent
Nagata

(10) Patent No.: US 7,984,871 B2
(45) Date of Patent: Jul. 26, 2011

(54) ROLL PAPER TRANSPORTATION DEVICE AND PRINTING APPARATUS

(75) Inventor: Norio Nagata, Matsunoto (JP)

(73) Assignee: Seiko Epson Corporation, Tokyo (JP)

( * ) Notice: Subject to any disclaimer, the term of this patent is extended or adjusted under 35 U.S.C. 154(b) by 1065 days.

(21) Appl. No.: 11/431,458

(22) Filed: May 9, 2006

(65) Prior Publication Data

US 2006/0269348 A1 Nov. 30, 2006

(30) Foreign Application Priority Data

May 10, 2005 (JP) ..... 2005-136916

(51) Int. Cl.
*B65H 26/06* (2006.01)

(52) U.S. Cl. ..... 242/563.1; 242/566; 242/413.3

(58) Field of Classification Search ..... 242/417.3, 242/413.3, 418.1, 615, 615.1, 563, 563.1, 242/566; 347/16, 19, 5, 14; 400/615.2
See application file for complete search history.

(56) References Cited

U.S. PATENT DOCUMENTS

| | | | | |
|---|---|---|---|---|
| 4,173,420 | A * | 11/1979 | Okabe | 400/618 |
| 4,464,916 | A | 8/1984 | Grew et al. | |
| 4,913,575 | A * | 4/1990 | Wada | 400/638 |
| 5,082,384 | A * | 1/1992 | Kakaguchi | 400/605 |
| 5,292,397 | A | 3/1994 | Lorenz et al. | |
| 5,358,346 | A * | 10/1994 | Schmidt et al. | 242/615.1 |
| 6,152,631 | A * | 11/2000 | Park | 400/708 |
| 7,455,380 | B2 * | 11/2008 | Takeishi | 347/5 |

FOREIGN PATENT DOCUMENTS

| | | | |
|---|---|---|---|
| EP | 0 310 425 | | 4/1989 |
| EP | 1 530 401 | A | 5/2005 |
| FR | 2772736 | | 12/1997 |
| GB | 2 015 299 | A | 9/1979 |
| JP | 55-46523 | | 5/1977 |
| JP | 54048247 | A * | 4/1979 |
| JP | 55-046523 | | 10/1980 |

(Continued)

OTHER PUBLICATIONS

Extended European Search Report which issued in the corresponding EP application, citing the above references as well as a copy of the European Search Report filed in the USPTO on Aug. 30, 2007 which lists the additional U.S. reference cited above.

(Continued)

*Primary Examiner* — William A Rivera
(74) *Attorney, Agent, or Firm* — Michael T. Gabrik

(57) ABSTRACT

A printing apparatus and a roll paper transportation device which reduces the space needed to accommodate a roll paper buffer mechanism unit and paper detection unit, and to reduce poor electrical contact in the contact part of the paper detection unit. The roll paper transportation device has a paper detection unit 8 for detecting the presence of roll paper 5, and a buffer mechanism unit 7 for absorbing variation in roll paper tension in order to keep the roll paper 5 tension less than or equal to a predetermined level. The buffer mechanism unit 7 forms a housing unit 16 for housing at least part of the paper detection unit 8 in a common area disposed in the buffer mechanism unit 7 enabling the paper detection unit 8 and buffer unit 7 to operate in unison without interfering with the operation of the other.

9 Claims, 7 Drawing Sheets

FOREIGN PATENT DOCUMENTS

| | | |
|---|---|---|
| JP | 63-38191 | 6/1983 |
| JP | 59-050767 | 4/1984 |
| JP | 64-060534 | 3/1989 |
| JP | 64-87374 | 3/1989 |
| JP | 04193330 | 6/1992 |
| JP | 5-286184 | 11/1993 |
| JP | 06-008554 | 1/1994 |
| JP | 10-129904 | 5/1998 |
| JP | 2000-062281 | 2/2000 |
| JP | 2001-302043 | 10/2001 |
| JP | 2002-321848 | 11/2002 |
| JP | 2003 153392 A | 5/2003 |

OTHER PUBLICATIONS

Ref A6/61231 EP 06007827.6-1256 European Patent Office Jul. 23, 2007.

* cited by examiner

ROLL PAPER TRANSPORTATION DEVICE AND PRINTING APPARATUS

BACKGROUND OF THE INVENTION

1. Field of technology

The present invention relates to a roll paper transportation device for conveying roll paper smoothly, and to a printing apparatus comprising this roll paper transportation device.

2. Description of Related Art

Conventional printers that use roll paper commonly have a tension-absorbing buffer mechanism that keeps the roll paper tension less than or equal to a predetermined level. This buffer mechanism is supported so that it can move elastically to maintain constant tension on the roll paper. See, for example, Japanese Unexamined Patent Appl. Pub. H06-8554.

Arrangements having a buffer plate for alleviating the high tension produced by the inertia of the core around which the paper is rolled at the start of roll paper transportation are also known. Inertia increases as the diameter of the paper core increases. Compared with a printer in which the roll paper is supported on a shaft, the inertia of the core is particularly great and the resulting tension is high in so-called drop-in loading printers in which the paper roll is simply placed inside the roll paper compartment.

A paper detection unit may also be disposed near the buffer plate to detect if roll paper is present. Friction produced during roll paper transportation can produce static electricity, which can build up and then be discharged to the paper detection unit near the paper transportation path, thus damaging or destroying the paper detection unit. If the paper detection unit uses a photosensor, the location of the circuit unit at the sensor surface makes the circuitry particularly susceptible to damage caused by the static charge being discharged directly to the circuit unit. A metal buffer plate can be disposed surrounding the photosensor in order to avoid static discharge by draining the electrostatic charge through the metal buffer plate, thereby preventing discharge to the photosensor as taught, for example, in Japanese Unexamined Patent Appl. Pub. 2000-62281. This, however, requires a complicated metal processing operation to shape the buffer plate, thus increasing the cost. In addition, the buffer plate must be electrically connected to the frame by a wire, for example, in order to reliably drain the static charge from the buffer plate to the frame, thus further complicating the construction and adding to the cost.

An arrangement that uses a mechanical switch could be used instead of a photosensor in the paper detection unit as a means of avoiding damage caused by static electricity. FIG. 7 is a section view showing the paper detection unit and buffer mechanism in a conventional thermal printer. As shown in FIG. 7 this printer 30 holds a paper roll 32 into which the roll paper 31 is wound. The roll paper 31 is held between the print head 33 and platen 34. Rotating the platen 34 causes the roll paper 31 to advance. The paper detection unit 37 detects the presence of roll paper 31 in response to movement in the position of a switch lever 38 extending from a paper detection unit 37. The switch lever 38 pivots to separate the paper detection unit 37 from the roll paper 31. In addition, the switch lever can be made from plastic or other nonconductive material so that static electricity produced by the roll paper 31 can be prevented from being discharged to the paper detection unit 37. The buffer plate 36 of the buffer mechanism 35 and the switch lever 38 of the paper detection unit 37 are also disposed to the transportation path between the paper roll 32 and platen 34 along the transportation direction of the roll paper 31. The buffer plate 36 can rock and thus works to absorb the strong tension applied to the roll paper 31 by the inertia of the paper roll 32 when paper transportation starts.

The paper detection unit 37 for detecting the roll paper 31 is composed of switch lever 38 and a mechanical switch 39. The switch lever 38 touches the roll paper 31 and can pivot. If roll paper 31 is present, the switch lever 38 pivots and moves to position Q, causing the contact part 41 on the end of the switch lever 38 to contact the contact lever 40 (contact terminal) inside the mechanical switch 39, and thus turns the switch on. If roll paper 31 is not present, the switch lever 38 moves to position P, thus separating from the contact lever 40 and turning the switch off. When roll paper 31 is loaded and contacts the switch lever 38, the switch lever 38 pivots and moves to position Q, the contact part 41 contacts contact lever 40, and the switch turns on. Whether roll paper 31 is present can thus be detected from the change in the on/off state of the switch.

A problem with the prior art taught in Japanese Unexamined Patent Appl. Pub. H06-8554 is that the buffer mechanism requires the installation space between the paper roll 32 and platen 34 to be large to accommodate both the buffer mechanism and paper detection apparatus. As shown in FIG. 7, a long distance L1 is required between the paper roll 32 and platen 34 in order to dispose the buffer mechanism 35 and paper detection unit 37 along the transportation direction of the roll paper 31.

Yet further, when a mechanical switch is used instead of a photosensor for the paper detection unit in order to avoid damage caused by electrostatic discharge, problems specific to the mechanical switch also arise. When the roll paper 31 is conveyed, variation in the load due to the friction of roll paper transportation, as well as shifting of the roll paper side to side and variation in the vertical movement of the paper during roll paper transportation, cause the position of the switch to change. Though slight, the roll paper 31 position also changes repeatedly between roll paper positions R1 and R2 even when a buffer plate 36 is used. As the position of the roll paper 31 changes, the switch lever 38 also pivots repeatedly, although the distance moved is slight, and the switch lever 38 thus slides repeatedly in contact with the contact lever 40 (in the on position) at the contact part 41 of the mechanical switch 39. This gradually wears on the contact part 41 and eventually results in poor electrical contact.

To solve these problems, an object of the present invention is to provide a roll paper transportation device and printing apparatus that minimizes the space required to accommodate the buffer mechanism and paper detection unit and to prevent poor electrical contact at the contact part of the mechanical switch that is used in the paper detection unit.

SUMMARY OF THE INVENTION

To achieve this object, a roll paper transportation device according to the present invention is a device for conveying roll paper along a transportation path, and comprises; a paper detection unit for detecting the presence of roll paper on the transportation path, and a buffer mechanism unit for absorbing variation in roll paper tension to hold the tension in the roll paper less than or equal to a predetermined tension wherein the buffer mechanism unit forms a housing unit for housing at least part of the paper detection unit in a common area disposed in the buffer mechanism unit and wherein both said buffer mechanism unit and said paper detection unit operate from said common area in unison either independent of one another or in conjunction with one thereby substantially minimizing the space for housing the buffer mechanism unit and paper detection unit in the device. The buffer mechanism forms the guide surface for the roll paper and controls its movement. In the preferred embodiment the paper detection unit has a lever detecting member which is disposed in the common area of the buffer mechanism unit and moves in conjunction with movement of the guide surface permitting the paper detection unit and buffer mechanism unit to operate in unison.

This roll paper transportation device can hold the paper detection unit together with the buffer mechanism unit in a housing unit formed by the buffer mechanism unit in common with the paper detection unit. More particularly, by locating all of the paper detection unit within the area occupied by the buffer mechanism unit, the space required to render both can be significantly reduced compared with arrangements in which the buffer mechanism unit and paper detection unit are located in different places. The paper detection unit and buffer unit can also function independently without interfering with the operation of the other. The roll paper transportation device can thus be rendered more compactly while achieving the functions of the paper detection unit and roll paper transportation device.

Preferably, the buffer mechanism unit comprises a buffer plate which provides a guide surface forming a roll paper transportation path for guiding the roll paper along a selected transportation direction. Further preferably, the buffer plate is mounted in the housing unit in an arrangement that enables the buffer plate to roll and the roll paper transportation path to move i.e. shift position causing the transportation direction of the roll paper to change when the buffer plate rolls as is shown in FIG. 4 in order to absorb tension on the roll paper The buffer plate is aligned to intersect perpendicularly the transportation direction of the roll paper.

The buffer plate of the buffer mechanism unit in this aspect of the invention provides a guide surface for guiding the roll paper. The guide surface of the buffer plate is disposed to a position that changes the transportation direction of the roll paper, guides the roll paper along the guide surface, and compensates for movement of the roll paper side to side and vertically. By thus guiding the roll paper over this guide surface the roll paper can be conveyed correctly along the transportation direction. The buffer plate is also arranged so that the buffer plate can roll for causing the roll paper transportation path to shift from one position to another respectively. When the roll paper is pulled suddenly off the paper roll such as at the start of printing, the tension on the roll paper momentarily increases greatly. The resulting high tension (or change in tension) can interfere with or prevent normal paper transportation, and can result in uneven stretching of the roll paper, wrinkles, and even tears. The resulting overload on the paper feed motor can also prevent the motor from operating normally or even damage the motor. To avoid such problems, the buffer plate rolls in the direction alleviating this tension when high tension is suddenly applied to the roll paper i.e. pivots in the direction to shorten the length of the transportation path. This rolling prevents applying excessive tension to the roll paper.

Further preferably, the paper detection unit for detecting if roll paper is present has a detection lever that pivots when in contact with the roll paper. The detection lever is in an arrangement that pivots in conjunction with the guide surface when the detection lever is in contact with the roll paper and the buffer plate rolls so that the detection lever alone will not protrude from the guide surface of the buffer plate to the roll paper side.

The paper detection unit in this aspect of the invention has a detection lever disposed so that when roll paper is loaded and contacts the detection lever, the detection lever is depressed by the roll paper and the paper detection unit operates, thereby detecting if roll paper is loaded or not. When tension is applied to the roll paper and the buffer plate pivots, the detection lever pivots in conjunction with the buffer plate and is held in a position not protruding from the guide surface of the buffer plate. If the detection lever does not move in conjunction with the guide surface and protrudes from the guide surface, the roll paper will rub against the end of the detection lever, leaving striped lines or marks in the paper, and resulting in printing defects in the printed roll paper. If thermal paper is used, this friction can cause the paper to discolor and become unusable. By causing the detection lever to move in conjunction with the guide surface and not protrude from the guide surface, the quality of the printed roll paper is not impaired.

Yet further preferably, the detection lever for detecting if roll paper is present pivots in a direction parallel to the direction in which the buffer plate extends when the detection lever contacts the roll paper.

The paper detection unit in this aspect of the invention can detect if roll paper is present as a result of the detection lever pivoting in the direction substantially parallel to the direction in which the buffer plate extends when the roll paper is loaded and brought in contact with the detection lever. By rotating parallel to the orientation of the buffer plate, the detection lever follows a path of rotation that is contained within the area of the buffer mechanism unit to which the buffer plate is disposed. The detection lever therefore moves within the range of the buffer mechanism unit even if the detection lever pivots through a large path of rotation, and a separate space allowing the detection lever to pivot need not be provided. Less space is therefore needed to render the paper detection unit.

A roll paper transportation device for conveying roll paper according to another aspect of the invention comprises a paper detection unit for detecting the presence of roll paper. The paper detection unit comprises a detection lever that pivots when roll paper is present in order to detect the roll paper, a cam formed integrally with the detection lever and having a curved surface that is concentric to the rotary axis of the detection lever, and a switch lever that contacts the curved surface of the cam.

The paper detection unit of this roll paper transportation device detects if roll paper is present or not. When roll paper is loaded and contacts the detection lever, the detection lever of the paper detection unit is depressed and pivots. When the detection lever thus pivots, the cam formed integrally with the detection lever also turns. The cam has a curved surface rendered concentrically to the rotary axis of the detection lever. The switch lever is pushed and rocked by the curved surface of the cam as the cam turns, moving from a position separated from the curved surface of the cam to a position in contact with the curved surface for operating a mechanical switch.

More specifically, when the switch lever is pushed by the curved surface of the cam, the switch lever inside the mechanical switch swings and contacts a contact terminal, thereby operating the mechanical switch. Furthermore, because the mechanical switch is operated by means of a detection lever, cam, and switch lever, the small force exerted on the switch lever by the roll paper can be amplified by adjusting the lengths of the levers and the shape of the cam, and the mechanical switch can be reliably operated. Using a detection lever and cam also enables increasing the distance from the roll paper to the mechanical switch, and discharging static produced by the roll paper to the mechanical switch can be reliably prevented.

Yet further preferably, when roll paper is loaded and the detection lever is depressed by the roll paper and pivots, the switch lever contacts the curved surface of the cam rotating in conjunction with the detection lever.

When the roll paper is loaded in this aspect of the invention, the switch lever follows the cam and rides onto and in contact with the curved surface of the cam. The switch lever rides on the curved surface of the cam, contacts the contact terminal of the mechanical switch, and operates the mechanical switch. As the load changes while conveying the roll paper and the detection lever moves repeatedly in conjunction with this change in the load, the switch lever slides along the curved surface of the cam but does not rock because the curved cam surface is concentric with the rotary axis of the detection lever. More particularly, the switch lever does not pivot repeatedly as the position of the roll paper changes slightly, and the switch lever therefore does not slide against the contact terminal of the mechanical switch. Sliding between the switch lever and the contact terminal of the mechanical switch can thus be limited, and contact wear caused by such sliding and poor electrical contact caused by contact wear can be prevented.

A printing apparatus according to another aspect of the invention is a printing apparatus comprising a roll paper transportation device according to the present invention.

This printing apparatus comprises a compact roll paper transportation device including a paper detection unit and a buffer mechanism unit forming a housing unit for housing the paper detection unit with each at least partially occupying common space provided in the buffer mechanism unit for operating in unison either independent of one another or in conjunction with one another. As a result, the printing apparatus can alleviate producing excessive tension on the roll paper by means of the rocking mechanism of the buffer plate of the buffer mechanism unit. Furthermore, because the detection lever that detects the roll paper does not protrude from the guide surface of the buffer plate, damage caused by the detection lever rubbing against the roll paper can be prevented. Furthermore, when a mechanical switch is used in the paper detection unit, sliding between the switch lever and the contact terminal of the mechanical switch can be limited, and contact wear caused by such sliding and poor electrical contact caused by contact wear can be prevented. Discharging static electricity produced by the roll paper can also be prevented, thus also preventing damage to the paper detection unit. A compact printing apparatus affording the benefits described above can thus be provided by rendering the roll paper transportation device of this invention in the printing apparatus.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a roll paper transportation device and printing apparatus according to the present invention are described hereafter with reference to the accompanying figures.

Figure 1:
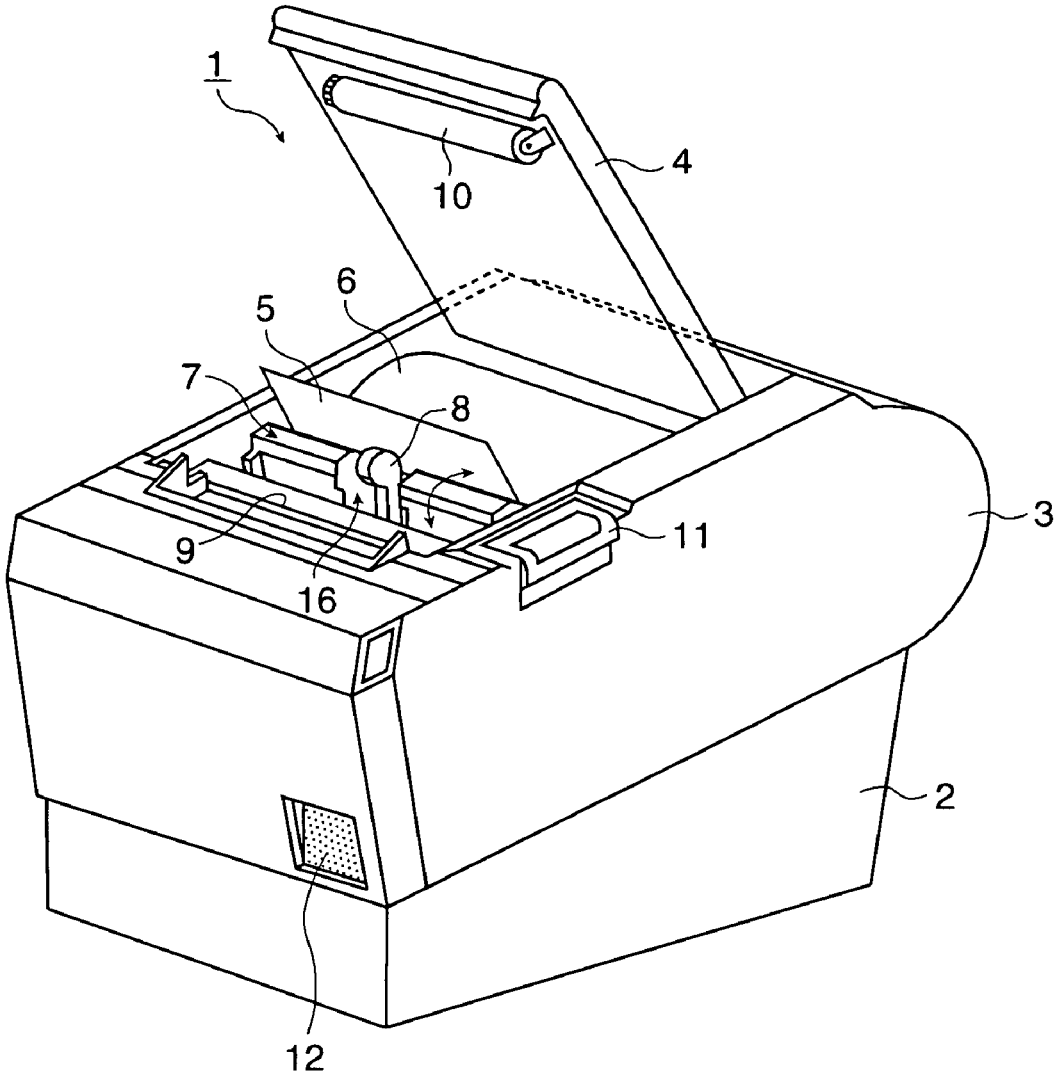
FIG. 1 is an oblique view showing the exterior of a printing apparatus.

As shown in FIG. 1, the printer 1 has a bottom case 2 and a top case 3. The top case 3 has a cover 4 that opens and closes freely above the printer 1. Disposed inside the space accessible by opening the cover 4 are the paper roll 6 (shown in part in the figures) formed by winding the roll paper 5 into a roll, a buffer unit 7 for absorbing changes in tension in order to hold the roll paper 5 tension equal to or less than a predetermined tension level, a housing unit 16 combining the buffer unit 7 and a paper detection unit 8 with each at least partially occupying common space provided in a cut-away portion of the buffer unit 7. The paper detection unit 8 is at least partially disposed inside the housing unit 16 for detecting the presence of roll paper 5. The printer 1 further includes a print head 9 for printing to the roll paper 5 and a platen 10 disposed to the cover 4 so that closing the cover 4 sandwiches the roll paper 5 between the platen 10 and print head 9. The roll paper 5 is conveyed by rotating the platen 10, and the print head 9 prints on the roll paper 5.

Figure 3:
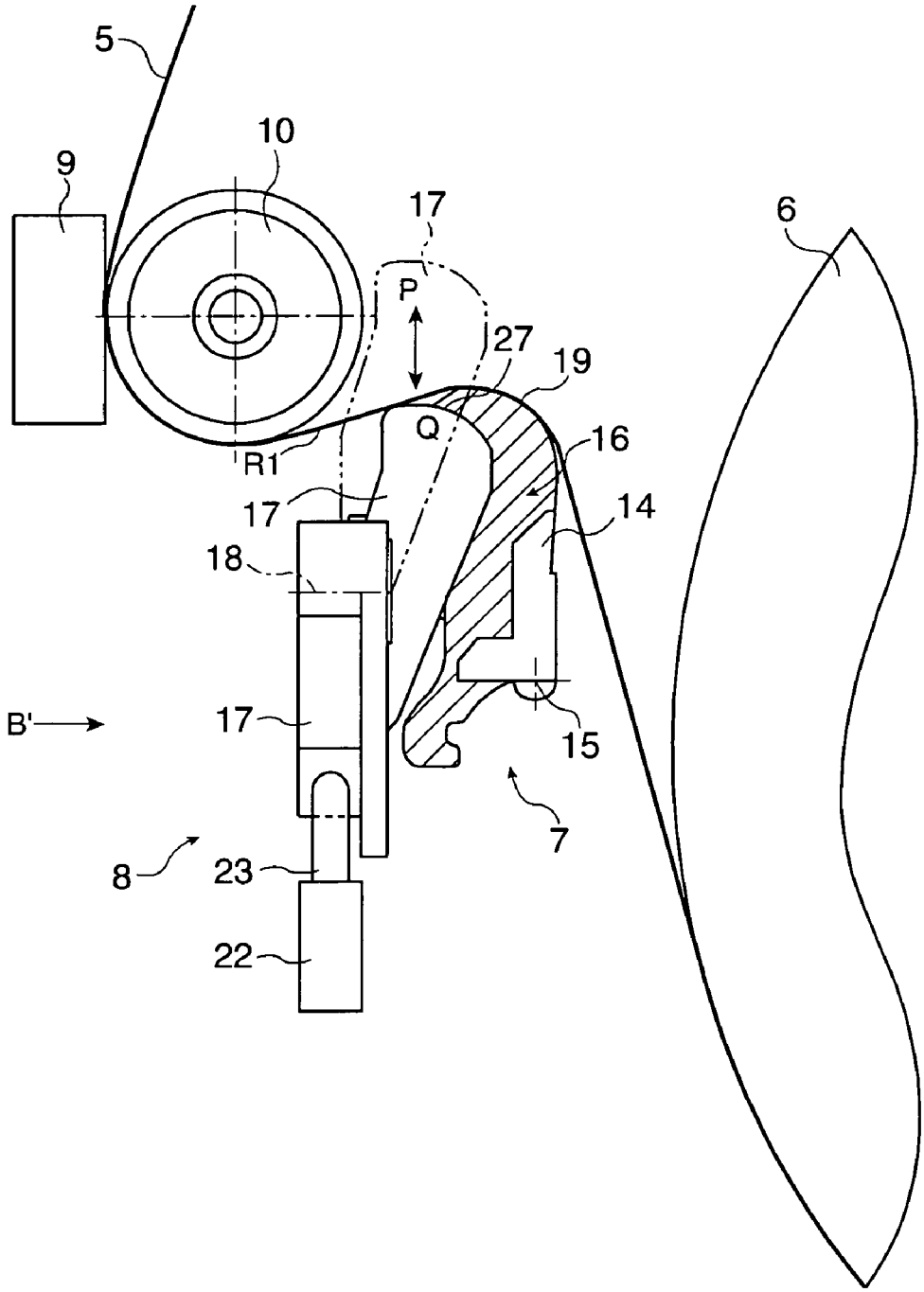
FIG. 3 is a section view showing roll paper loaded in the roll paper transportation device.

A cover opening button 11 for opening the cover 4 is located on the top of the top case 3, and a power switch 12 is located at the front of the top case 3. As shown in FIG. 3, the buffer unit 7 guides the roll paper 5 to the print head 9 and buffers high tension applied to the roll paper 5. The buffer unit 7 has a buffer plate 14 which pivots on a pivot axis 15 in order to absorb tension, and pivots (rocks) toward the print head 9 when the tension increases and returns toward the paper roll 6 when the tension decreases so that the buffer plate 14 can guide the roll paper 5. During this time the buffer plate 14 extends substantially widthwise to the roll paper 5 in a lateral direction i.e., at a right angle to the feed direction of the roll paper and in parallel to the pivot axis 15.

The paper detection unit 8 has a detection lever 17 that contacts the roll paper 5 and pivots on the rotary axis 18, a mechanical switch 22 that detects the presence of roll paper 5, and a switch lever 23 that transfers rotation of the detection lever 17 to the mechanical switch 22.

Figure 2:
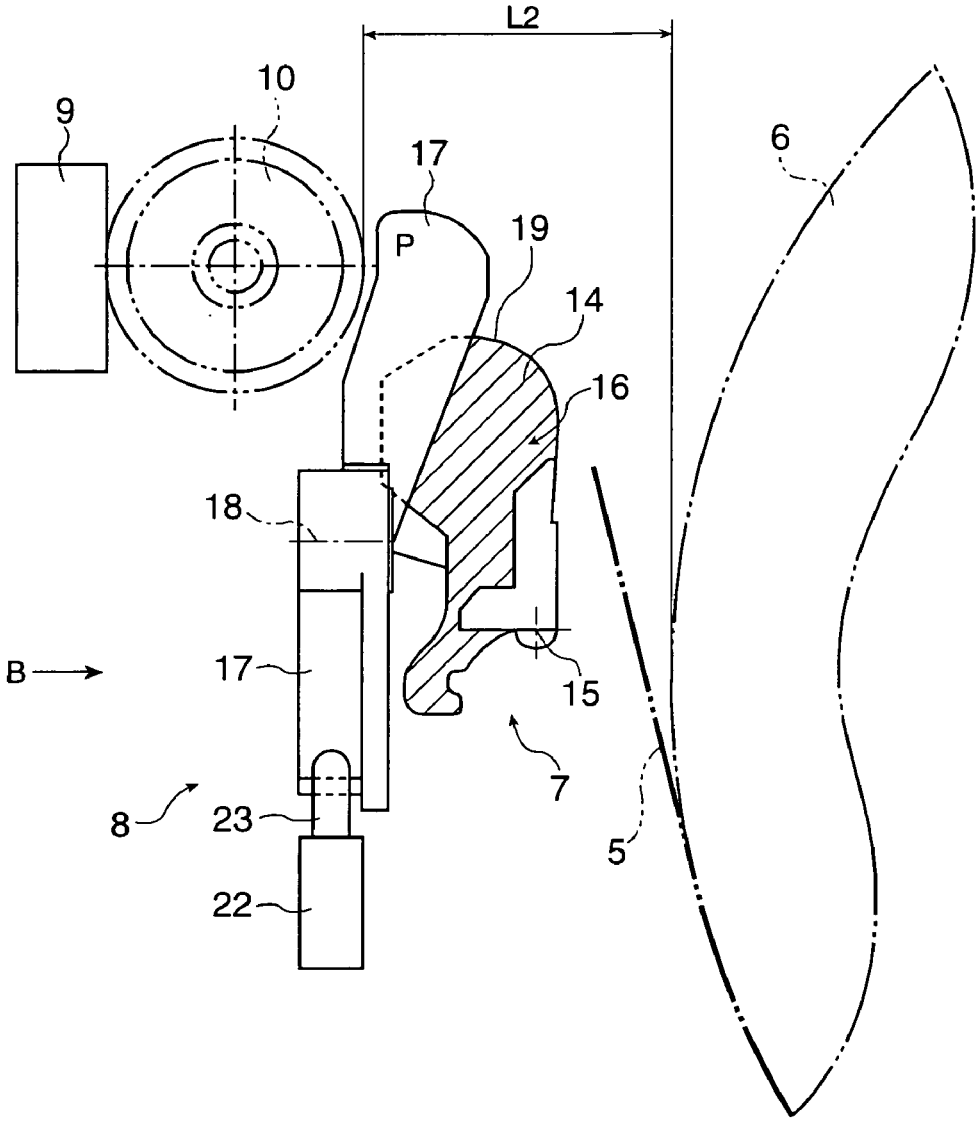
FIG. 2 is a section view describing the relative positions of the buffer mechanism unit and paper detection unit of the roll paper transportation device.

To load roll paper 5 into the printer 1, the cover opening button 11 is pressed to open the cover 4 as shown in FIG. 1, and the paper roll 6 is then placed inside the top case 3, resulting in the state shown in FIG. 2. The roll paper 5 is then pulled out from the paper roll 6 in the direction of print head 9 so that the roll paper 5 covers the buffer unit 7 and the guide surface 19 of buffer plate 14 that guides the roll paper 5. Closing the cover 4 after thus pulling and positioning the roll paper 5 from the paper roll 6 results in the roll paper 5 being threaded through the transportation path as shown in FIG. 3 with the platen 10 attached to the cover 4 pressing the roll paper 5 against the print head 9. This causes the roll paper 5 to push the detection lever 17 of the paper detection unit 8, causing the detection lever 17 to pivot and descend to position Q from the position P of the detection lever 17 when the roll paper 5 is not loaded (not present). The detection lever 17 pivots on the rotary axis 18 that extends in the direction perpendicular to the pivot axis 15. Hence a component of the pivotal motion of the detection lever 17 causes movement of the lever 17 in the lateral direction substantially parallel to the extension of the buffer plate 14.

Figure 7:
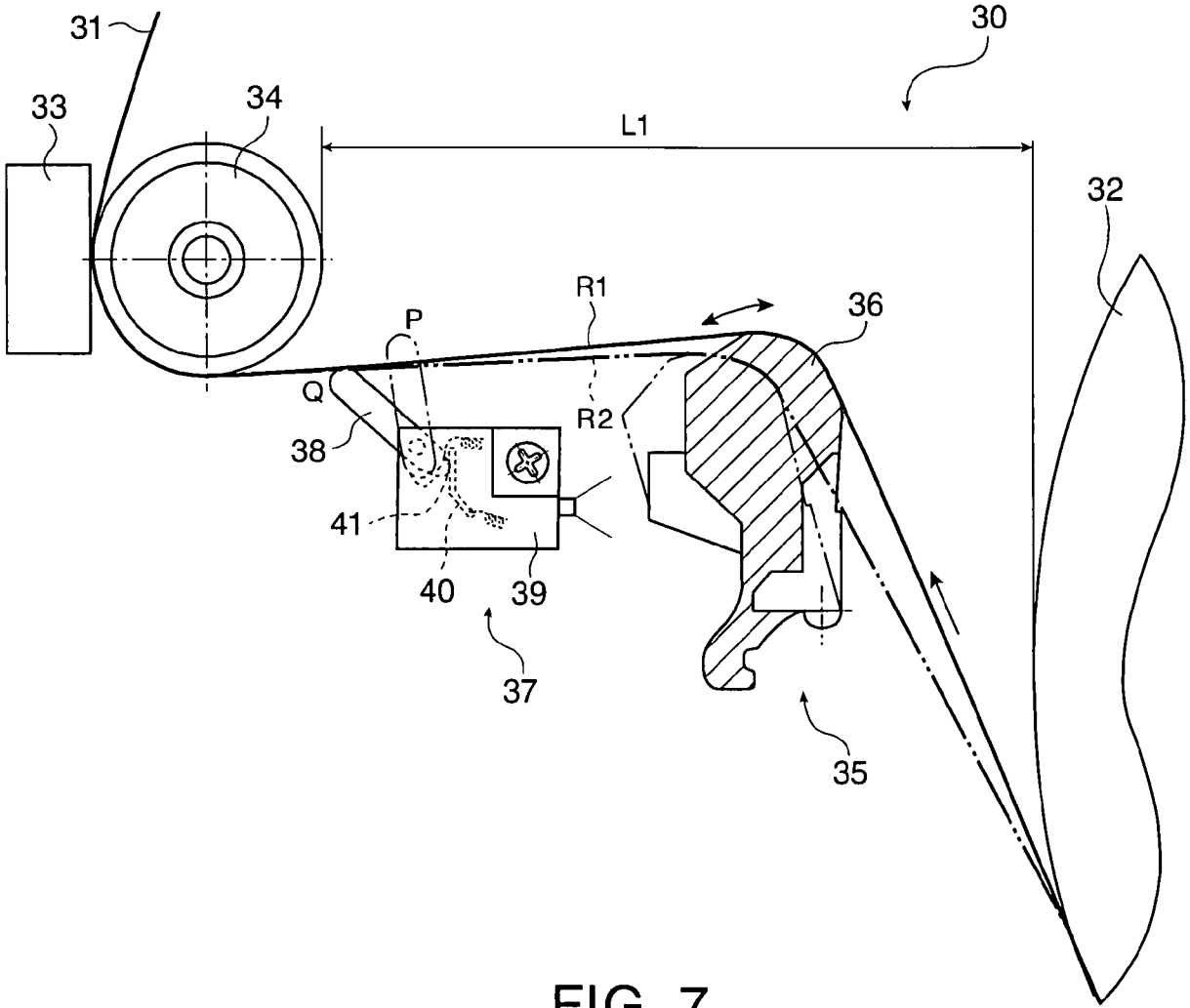
FIG. 7 is a section view showing the paper detection unit and buffer mechanism in a conventional thermal printer.

The buffer unit 7 is located between the paper roll 6 and platen 10. The paper detection unit 8 is contained within the housing unit 16 occupying a common area provided by the buffer unit 7. This arrangement greatly reduces the space needed to accommodate a buffer unit 7 and a paper detection unit 8 when compared with prior art arrangements in which the buffer unit 7 and paper detection unit 8 are spaced a substantial distance apart from one another as shown in FIG. 7. The distance L2 in FIG. 2 between the paper roll 6 and platen 10 can thus be shorter than the distance L1 between the paper roll 32 and platen 34 in FIG. 7, enabling a reduction in overall size while retaining the functionality of the buffer mechanism unit and paper detection unit.

The roll paper 5 loaded in the printer 1 passes from the paper roll 6 over the guide surface 19 of the buffer plate 14 and then to the platen 10. As shown in FIG. 3, this causes the detection lever 17 of the paper detection unit 8 to descend and pivot so that the detection lever 17 is held completely in line (widthwise to the roll paper 5) with the buffer plate 14. Pivoting of the detection lever 17 operates the mechanical switch 22 by means of switch lever 23, and the presence or absence of the roll paper 5 is detected by the mechanical switch 22. The roll paper 5 passes between the platen 10 and print head 9, and is held by the pressure of the platen 10 against the print head 9. The roll paper 5 is then conveyed by rotating the platen 10 by means of a feed motor not shown. The print head 9 then prints on the roll paper 5 as the roll paper 5 is conveyed, and the roll paper 5 is discharged externally to the printer 1. An automatic paper cutter not shown cuts the roll paper 5 to length for removal.

Rotation of the platen 10 pulls the roll paper 5 from the paper roll 6 and supplies the roll paper 5 to the print head 9. The print head 9 in this embodiment of the invention is a thermal print head and the roll paper 5 is thermal paper. The roll paper 5 supplied to the print head 9 reacts to the heat produced by the heat elements of the print head 9 and changes color. The printer 1 prints as desired by controlling where the roll paper 5 changes its color.

As shown in FIG. 2 and FIG. 3, the roll paper transportation device comprises a transportation unit for holding and conveying the roll paper 5 by means of the print head 9 and platen 10, the buffer unit 7, and the paper detection unit 8.

Transportation of the Roll Paper 5 is Described Next.

This printer 1 does not support the paper roll 6 on a spindle, but instead uses a drop-in loading system enabling the user to simply set the paper roll 6 into the roll paper compartment inside the top case 3. Using a drop-in loading system enables the user to simply set the paper roll 6 inside the printer 1 because there is no need to pass a spindle through the center of the paper roll 6. When the platen 10 starts turning to start transporting the roll paper 5 to the print head 9 at the start of printing, the resting paper roll 6 must be rotated in order to pull the roll paper 5 off the paper roll 6. In order to pull the roll paper 5, the paper roll 6 must be turned with sufficient force to overcome the friction of the transportation path and the inertia working to hold the paper roll 6 at rest. This temporarily produces high tension in the roll paper 5 and applies a large load on the motor that drives the platen 10. As the printing speed has increased in recent printers, the roll paper 5 supply rate has also increased, thus producing even greater tension and applying an even greater load on the motor. Inertia also increases as the diameter of the paper roll 6 increases. When the paper roll 6 is replaced and a new paper roll 6 is loaded, the roll diameter is large. As a result, the tension on the roll paper 5 is high. These factors can result in a load large enough to prevent the motor from starting to turn. If the motor being used is a DC motor, this can result in a large current that can, in the worst case, damage the motor. If a stepping motor is being used, this load can cause the motor to lose synchronization, resulting in damage to the motor.

If the motor starts turning, rotation of the platen 10 starts to pull the roll paper 5 and begins supplying the roll paper 5 to the print head 9. The tension on the roll paper 5 at this time is temporarily high, which can cause the roll paper 5 to wrinkle, stretch, or even tear, problems that do not normally occur during roll paper 5 transportation. If the printer 1 is a POS printer for printing cash register receipts, a different receipt is printed for each transaction, roll paper 5 transportation starts and stops frequently, and the problems resulting from high paper tension occur repeatedly.

Figure 4:
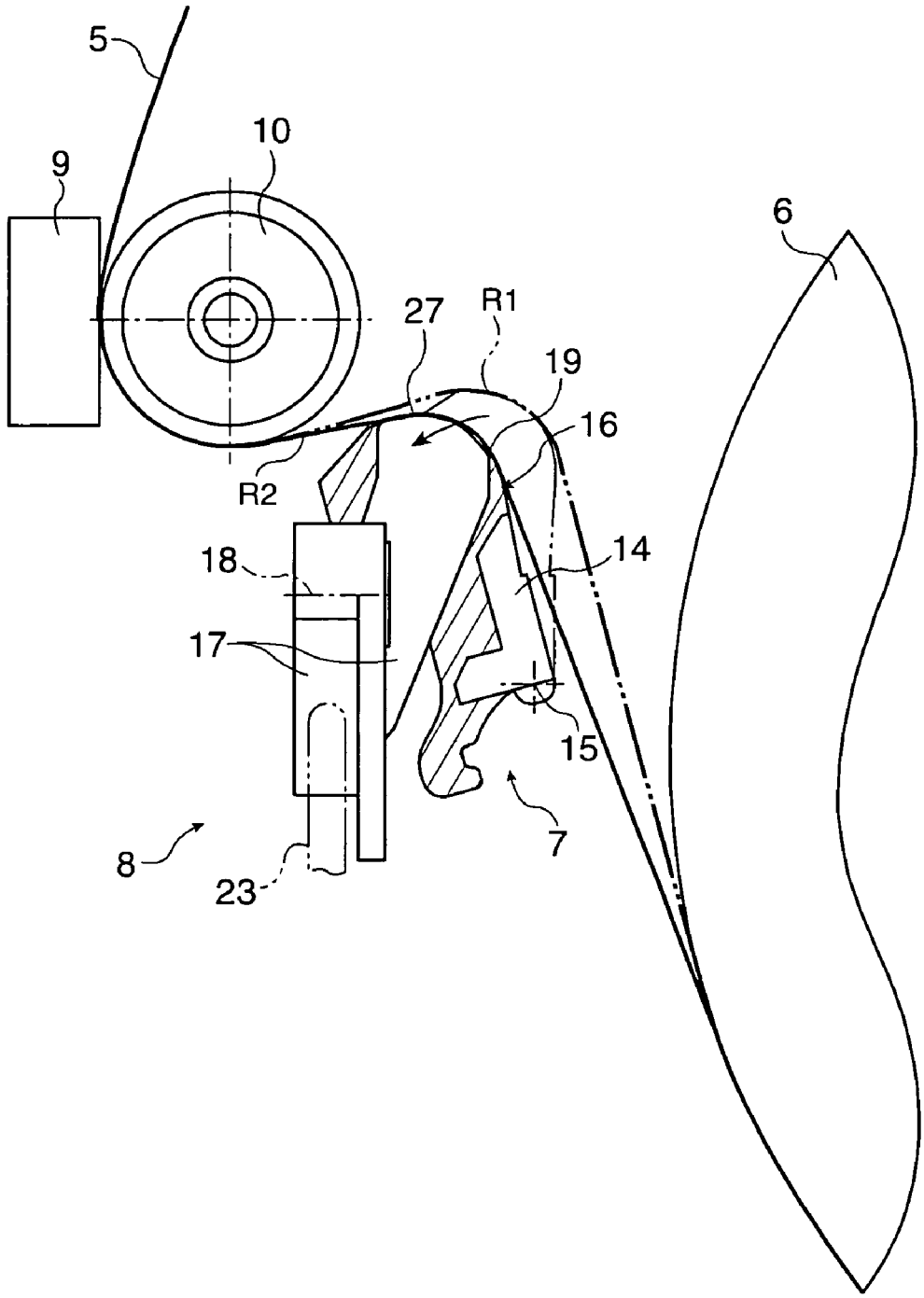
FIG. 4 is a section view showing transporting the roll paper when tension is applied to the roll paper.

To solve this problem, the printer 1 according to the present invention has a buffer unit 7 for buffering changes in tension on the roll paper 5 and the load on the motor. FIG. 4 is a section view showing a case in which the tension on the roll paper is high. The inertia of the paper roll 6, for example, causes high tension to be applied to the roll paper 5 when the platen 10 starts turning to start printing after the printer 1 has stopped. An urging member (not shown?) that urges the buffer plate 14 toward the paper roll 6 is disposed inside the buffer unit 7. When the tension on the roll paper 5 is high, the buffer plate 14 of the buffer unit 7 pivots on the pivot axis 15 toward the platen 10 while resisting this tension. When the buffer plate 14 turns toward the platen 10, the urging force of the urging member inside the buffer unit 7 buffers the tension on the roll paper 5. As a result, transporting the roll paper 5 can start when the platen 10 starts turning without producing a momentarily high load on the motor. Instead the momentarily high load will cause the buffer plate 14 to rotate. FIG. 4 shows the buffer plate 14 when it is maximally rotated towards the platen 10 by this momentarily high load. The buffer unit 7 for absorbing variation in roll paper tension can hold the tension less than or equal to a predetermined tension (less than the maximum tension). When the roll paper 5 is being transported normally, the buffer plate 14 does not pivot to the position shown in FIG. 4.

When the paper roll 6 starts turning and the roll paper 5 then begins travelling at a constant speed, the load associated with conveying the roll paper 5 is determined by the reduced inertia of the paper roll 6, the friction load between the paper roll 6 and the surface of the top case 3 on which the paper roll 6 rests, and the friction load of the roll paper 5 and the guide surface 19 of the buffer plate 14 that guides the roll paper 5. These friction loads are low. The buffer plate 14 is thus returned toward the paper roll 6 from the position to which it was pivoted by the high tension on the roll paper 5 at the start of roll paper transportation by the urging member inside the buffer unit 7 because the roll paper tension drops as transportation continues. This tension buffering afforded by the rotation of the buffer plate 14 prevents excessive tension from being applied to the roll paper.

The distal end 27 of the detection lever 17 that detects the roll paper 5 is in the same plane as the guide surface 19 when the distal end 27 is in contact with the roll paper 5 as shown in FIG. 3 and FIG. 4. As shown in FIG. 3, when the roll paper 5 is loaded and the cover 4 is closed, the distal end 27 of the detection lever 17 moves from position P to position Q. Tension is not applied to the roll paper 5 at this time, and the buffer plate 14 does not pivot. When the distal end 27 of the detection lever 17 contacts the roll paper 5, the distal end 27 rotates into the same plane as the guide surface 19 and operates the mechanical switch 22. That roll paper 5 is loaded is thus detected.

When the platen 10 starts turning and high tension is applied to the roll paper 5, the buffer plate 14 pivots toward the platen 10 and works to buffer the tension as shown in FIG. 4. As the buffer plate 14 turns, the roll paper 5 moves from roll paper position R1 to R2 in contact with the guide surface 19 and the distal end 27 of the detection lever 17. The distal end 27 and guide surface 19 thus simultaneously pivot to roll paper position R2. When the roll paper 5 moves from roll paper position R1 to R2, the distal end 27 and guide surface 19 also remain in the same plane while moving.

Whether the buffer plate 14 moves toward the paper roll 6 or toward the platen 10, the distal end 27 pivots in conjunction with the buffer plate 14, remaining in the same plane as the guide surface 19 of the buffer plate 14, and the distal end 27 alone will not protrude into the path of the roll paper 5. The distal end 27 will therefore not cause wrinkles, marks, or other damage to the roll paper 5 by raising a localized part of the roll paper 5. In addition, as the tension on the roll paper 5 increases, the buffer plate 14 pivots further and the distal end 27 also pivots further in the direction in which the buffer plate 14 extends i.e., in the lateral direction. The distal end 27 thus moves to an inclined position, and the area in contact with the roll paper 5 gradually increases. This helps to further prevent damage to the roll paper 5. This arrangement is particularly effective when thermal paper is used because friction can cause the paper to change color and turn black.

Figure 5:
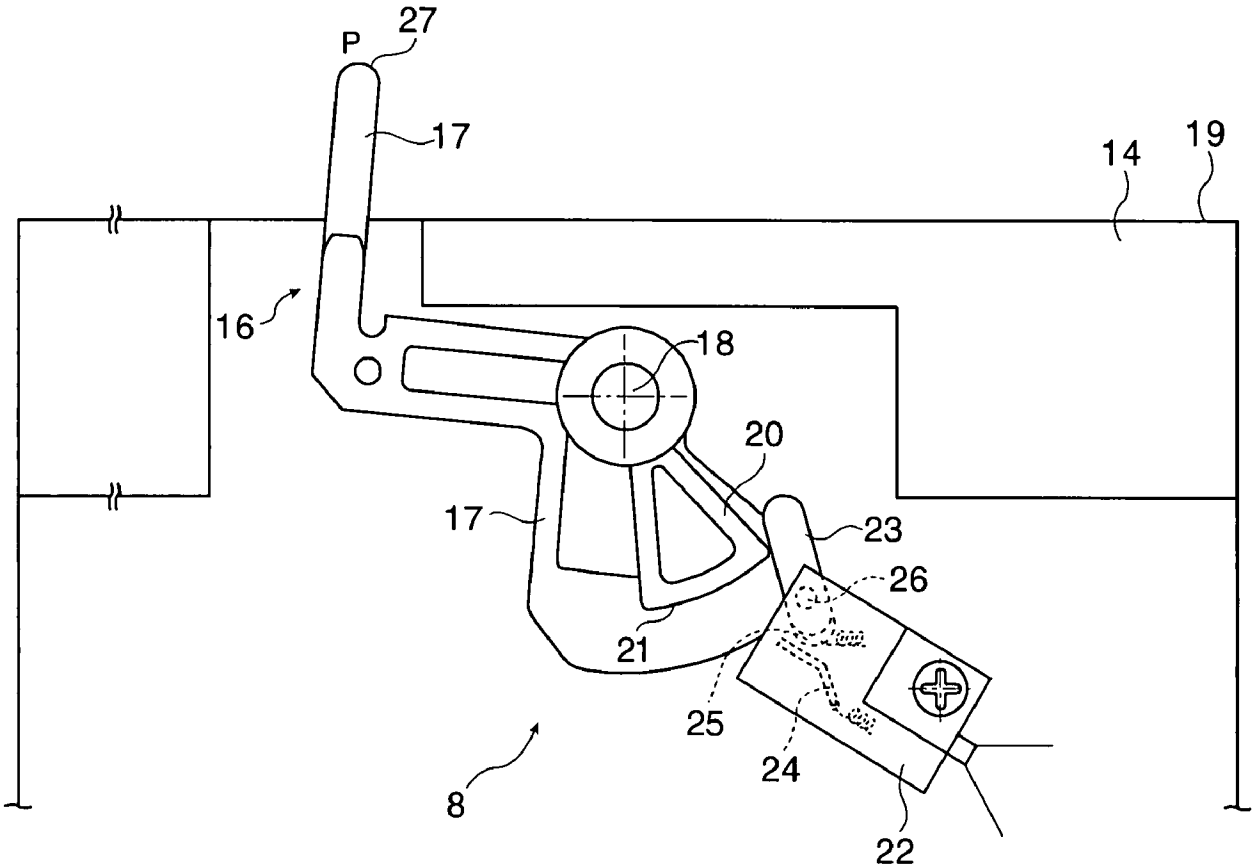
FIG. 5 is a front view showing the paper detection unit when roll paper is not present.
Figure 6:
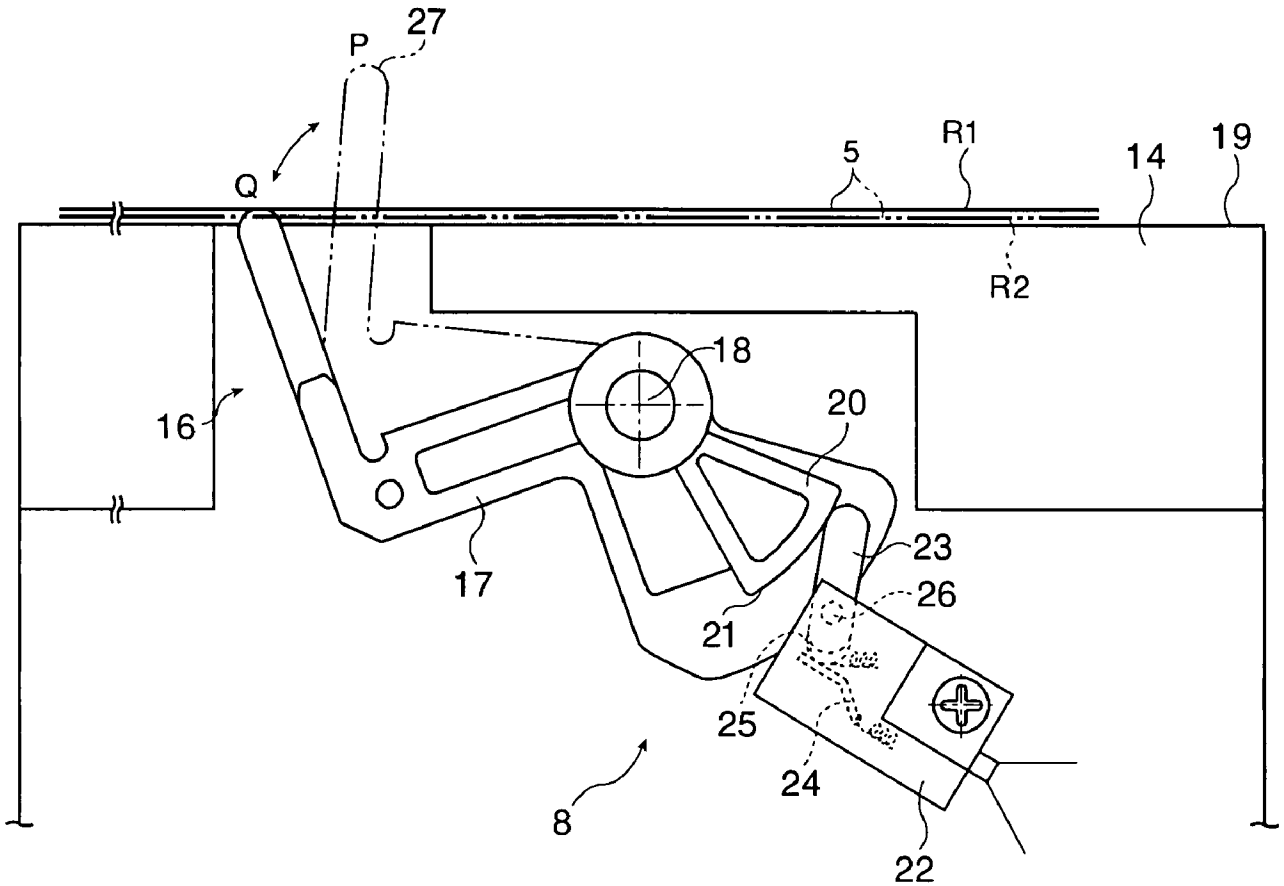
FIG. 6 is a front view showing the paper detection unit when roll paper is present.

The arrangement of the paper detection unit 8 is described in detail next. FIG. 5 is a front view showing the paper detection unit 8 when roll paper 5 is not present. FIG. 6 is a front view showing the paper detection unit 8 when roll paper 5 is present. FIG. 5 is a view of the paper detection unit 8 as seen through the position indicated by line B in FIG. 2, and FIG. 6 is a view of the paper detection unit 8 as seen through the position indicated by line B' in FIG. 3.

As shown in FIG. 5, the paper detection unit 8 is disposed inside the housing unit 16 in an area formed from a cut-out opening in the buffer plate 14 in line with the direction in which the buffer plate 14 extends. The paper detection unit 8 comprises the detection lever 17 that is pivotally supported on the rotary axis 18, a cam 20 formed integrally with the detection lever 17, a curved surface 21 that is concentric to the rotary axis 18, and the mechanical switch 22 which comprises the switch lever 23. The surface of the cam 20 and the switch lever 23 operate the mechanical switch 22 when the switch lever 23 is pivoted in contact with the cam 20. The distal end 27 of the detection lever 17 is rounded in order to not damage the roll paper 5.

The switch lever 23 pivots on the rotary axis 26 to make contact with a contact lever 24. The contact lever 24 is a flexible conductive metal member. When the switch lever 23 swings and contacts the contact lever 24, the contact lever 24 is elastically deflected in conjunction with rotation of the switch lever 23. A conductive metal contact 25 is rendered at the end part of the switch lever 23 that contacts the contact lever 24. Whether roll paper 5 is present or not is detected by sensing whether there is electrical conductivity between the contact 25 of the switch lever 23 and the contact lever 24.

When the paper detection unit 8 is not in contact with the roll paper 5 in the printer 1, the weight of the cam 20 causes the distal end 27 of the detection lever 17 to rise to position P above the guide surface 19 of the buffer plate 14. The switch lever 23 is thus freed from the cam 26, the contact lever 24 and contact 25 are not in contact, there is thus no electrical conductivity and the switch is off. When the switch lever 23 is not affected by an external force such as through the cam 20, the switch lever 23 is returned to the electrical off position by a spring or other urging member not shown. This is the normal position of the switch lever 23. When the switch lever 23 is in this normal position and the switch is off, the printer 1 determines that the roll paper 5 is not present.

When the roll paper 5 is loaded in the printer 1 and the cover 4 is closed, the distal end 27 of the paper detection unit 8 is pushed down by the roll paper 5 and thus pivots from position P to position Q as shown in FIG. 6. This pivoting of the distal end 27 causes the end of the cam 20 to push against the switch lever 23, and the switch lever 23 thus begins to pivot on the axis 26. When the distal end 27 pivots to position Q, the switch lever 23 moves from the end portion of the cam 20 onto the curved surface 21 of the cam 20, and thereafter moves in contact with the curved surface 21. When the switch lever 23 rides onto the curved surface 21, the switch lever 23 pivots, the contact 25 of the switch lever 23 makes electrical contact with the contact lever 24, and the switch turns on. The printer 1 detects that roll paper 5 is present when the switch is on.

During normal printing the roll paper 5 is at roll paper position R1 in contact with the distal end 27 of lever 17. When the printer is not printing and printing then starts, strong tension is applied to the roll paper 5, the buffer plate 14 thus pivots, and the roll paper 5 moves to roll paper position R2. The distal end 27 also moves in line with and following the movement of the guide surface 19. This movement occurs in conjunction with the pivoting of the buffer plate 14. When the buffer plate 14 pivots back and forth as printing starts and stops, the position of the roll paper 5 also changes repeatedly between position R1 and position R2. The distal end 27 also moves in conjunction with the paper. The distal end 27 may move during roll paper 5 transportation as a result of load changes caused by the friction of transporting the roll paper 5 or side to side or up and down play in the paper while transporting the roll paper 5. The curved surface 21 of the cam 20 also pivots in conjunction with the distal end 27 pivoting, but because the switch lever 23 has ridden up on the curved surface 21, the switch lever 23 simply slides along the same curved surface 21 and does not pivot on axis 26. The contact 25 of the switch lever 23 thus does not slide along the contact lever 24, and unnecessary sliding between the contact 25 and contact lever 24 can thus be controlled. Poor electrical contact resulting from contact 25 wear can also be reduced.

A roll paper transportation device and printer 1 according to a preferred embodiment of the invention is described above. The effect of this embodiment is described below.

(1) The paper detection unit 8 in the roll paper transportation device can pivot while housed within the housing unit 16 of the buffer unit 7 so that the paper detection unit 8 and buffer unit 7 can function independently without interfering with one another. A dedicated space for accommodating the paper detection unit 8 is therefore not needed, and the roll paper transportation device and printer 1 comprising the roll paper transportation device can be rendered more compactly.

(2) The distal end 27 of the detection lever 17 that contacts the roll paper 5 pivots substantially parallel to the direction in which the buffer plate 14 extends. More specifically, the distal end 27 operates by moving only within the distance L2 between the paper roll 6 and platen 10. A dedicated space is therefore not needed for the distal end 27 to pivot.

(3) When tension is applied to the roll paper 5, the buffer plate 14 pivots in the direction alleviating the tension. This pivoting of the buffer plate 14 prevents stretching, wrinkling, and tearing of the roll paper 5 as a result of excessive tension, avoids overloading the motor that drives the platen 10, and prevents damage to the motor and loss of synchronization. Printing defects resulting from these problems can also be prevented.

(4) The distal end 27 of the detection lever 17 does not protrude independently from the guide surface 19 toward the roll paper 5. As a result, the distal end 27 can be prevented from causing streaks and marks in the roll paper as a result of pushing up and rubbing against the roll paper 5, and the print quality of the printed roll paper 5 can be assured.

(5) The roll paper 5 is detected by operating a mechanical switch 22 by means of the detection lever 17 and switch lever 23. Even if the pressure of the detection lever 17 against the roll paper 5 is low, the mechanical switch 22 can be pushed and operated by adjusting the length ratio of the levers.

(6) The detection lever 17 has the distal end 27 and the cam 20 on opposite sides of the rotary axis 18. The weight balance is biased to the cam 20 side so that when there is no roll paper 5 the weight of the cam 20 causes the detection lever 17 to pivot so that the switch lever 23 returns to the normally off position. The detection lever 17 and cam 20 alone can therefore reset the mechanical switch 22 to the off position.

(7) Even if the detection lever 17 moves slightly in conjunction with roll paper 5 transportation, the switch lever 23 simply slides along the single curved surface 21 of the cam 20, thus limiting sliding between the switch lever 23 and the contact lever 24 of the mechanical switch 22. This prevents contact wear from repeatedly sliding slightly and prevents poor electrical contact resulting from such contact wear. The durability of the mechanical switch 22 is thus improved.

(8) The size of the detection lever 17 and the location of the mechanical switch 22 can be arranged as desired insofar as the paper detection unit 8 can be housed within the cut-out opening in the buffer plate 14 of the housing unit 16.

(9) The prior art teaches detecting a position of a lever with a photosensor. However, a mechanical switch 22, which is less expensive than a photosensor, can be used. Means of preventing the discharge of static electricity from the roll paper is therefore not necessary, and the cost of the roll paper transportation device and a printer 1 using the roll paper transportation device can be reduced.

The present invention is not limited to the embodiment of the invention described above, and can be varied as described by way of example below.

First Variation

The shape of the detection lever 17 of the paper detection unit 8 is not limited to a crank configuration such as shown in FIG. 5 and FIG. 6 if the balance of the detection lever 17 returns the distal end 27 to position P when there is no roll paper 5. An L-shaped or straight lever could be used, for example. This increases the freedom of designing the shape of the detection lever 17. An arrangement that resets the switch lever 23 to the normally off position by means of an urging member can also be used.

Second Variation

By thus being able to freely control the shape of the detection lever 17, the location of the cam 20 and curved surface 21 of the detection lever 17, and the location of the mechanical switch 22, are not limited to any specific position. The detection lever 17, cam 20, curved surface 21, and mechanical switch 22 could, for example, be disposed extending in a line substantially parallel to the orientation of the buffer plate 14. Alternatively, the detection lever 17, cam 20, curved surface 21, and mechanical switch 22 could, for example, be disposed substantially perpendicularly to the orientation of the buffer plate 14.

Third Variation

The shape of the guide surface 19 of the buffer plate 14 is not limited to a curve as shown in FIG. 2, and could be any curved surface centered on the pivot axis 15. As long as the guide surface 19 has a curved surface, movement of the roll paper between roll paper positions R1 and R2 can be substantially eliminated when the buffer plate 14 moves.

Fourth Variation

A printer 1 having the buffer unit 7 and paper detection unit 8 is not limited to printing by means of a thermal print head, and could use a dot impact head, an inkjet head, or other type of print head. The present invention can be applied to a wide range of printer types, and is not limited to any particular printing method. The roll paper transportation device is also not limited to a transportation drive mechanism that holds and conveys the roll paper 5 by means of the print head 9 and platen 10, and a transportation drive mechanism that uses a combination of rollers could be used.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper transportation device for conveying roll paper from a paper roll along a paper transportation path, comprising:

a paper detection unit for detecting the presence of said roll paper; and a buffer mechanism unit for absorbing variation in the tension of said roll paper;

wherein said buffer mechanism unit includes a movable member having a guide surface for the roll paper and having a buffer plate with a cut-away region adapted to accommodate part of the paper detection unit, and wherein said paper detection unit comprises a detection lever having a a distal end which is movably disposed between a first position in which the distal end of the detection lever projects from said guide surface and a second position in which the distal end of the detection lever rotates into the plane of the guide surface.

2. The roll paper transportation device described in claim 1, wherein:

the movable member of the buffer mechanism unit comprises a buffer plate having a guide surface forming said transportation path for guiding the roll paper with the buffer plate disposed in an arrangement that enables the buffer plate to pivot for controlling movement of the guide surface such that the roll paper transportation path shifts between different positions when the buffer plate pivots.

3. The roll paper transportation device described in claim 2, further comprising a roll paper transportation mechanism for drawing the roll paper from a paper roll and advancing the roll paper in a transportation direction along said transportation path and wherein said guide surface of said buffer plate extends perpendicular to said transportation direction with the buffer plate being movably supported and elastically biased such that said guide surface is movable to lengthen or shorten the transportation path so as to regulate the tension of the roll paper.

4. The roll paper transportation device described in claim 3, wherein:

the detection lever of said paper detection unit is mounted in said housing unit in an arrangement in which the detection lever is pivotally supported on a rotary axis and has a detection end for making contact with the roll paper when the roll paper is guided by the guide surface and wherein said detection lever pivots in conjunction with movement of the guide surface when the detection lever is in contact with the roll paper and the buffer plate rolls.

5. The roll paper transportation device described in claim 4, wherein:

the buffer plate is pivotally supported on a pivot axis that extends in a direction perpendicular to the paper transportation direction and parallel to the guide surface and the rotary axis of the detection lever extends in a direction perpendicular to the pivot axis of the buffer plate such that the pivotal motion of the detection lever causes a component of the detection lever to extend in a direction parallel to the direction in which the buffer plate extends.

6. A printing apparatus, comprising:

a roll paper transportation mechanism for conveying roll paper along a transportation path, a paper detection unit for detecting the presence of roll paper on said transportation path;

a buffer mechanism unit for absorbing variation in roll paper tension while being conveyed along the transportation path;

wherein said buffer mechanism unit comprises a movable member having a guide surface for guiding the roll paper and having a buffer plate with a cut-away region adapted to accommodate part of the paper detection unit, and wherein said paper detection unit-comprises a detection lever having a distal end which is movably disposed between a first position in which the distal end of the detection lever projects from said guide surface and a second position in which the distal end of the detection lever rotates into the plane as the guide surface.

7. The printing apparatus described in claim 6, wherein:

the movable member of the buffer mechanism unit comprises a buffer plate which is aligned to perpendicularly intersect the roll paper transportation direction, said buffer plate having a guide surface forming a transportation path for guiding the roll paper along the transportation direction with the buffer plate being pivotally mounted in said housing unit to control movement of the roll paper transportation path between different positions when the buffer plate is pivoted.

8. The printing apparatus described in claim 7, wherein:

the paper detection unit comprises a detection lever mounted in said housing unit in an arrangement in which the detection lever is pivotally supported on a rotary axis and has a detection end for making contact with the roll paper when the roll paper is guided by the guide surface and wherein said detection lever pivots in conjunction with movement of the guide surface when the detection lever is in contact with the roll paper and the buffer plate.

9. The printing apparatus described in claim 8, wherein:

the detection lever pivots parallel to the direction of orientation in which the buffer plate extends.

* * * * *

UNITED STATES PATENT AND TRADEMARK OFFICE

CERTIFICATE OF CORRECTION

PATENT NO. : 7,984,871 B2
APPLICATION NO. : 11/431458
DATED : July 26, 2011
INVENTOR(S) : Norio Nagata It is certified that error appears in the above-identified patent and that said Letters Patent is hereby corrected as shown below:

Column 13,
Line 3, please delete “rolls” after “plate”.

Column 14,
Line 4, please change “as” to --of--.

Signed and Sealed this
Twenty-fifth Day of October, 2011

David J. Kappos

David J. Kappos
*Director of the United States Patent and Trademark Office*